US011589618B2

(12) United States Patent
Ouyang

(10) Patent No.: US 11,589,618 B2
(45) Date of Patent: Feb. 28, 2023

(54) ELECTRONIC CIGARETTE

(71) Applicant: SHENZHEN IVPS TECHNOLOGY CO., LTD., Shenzhen (CN)

(72) Inventor: Junwei Ouyang, Shenzhen (CN)

(73) Assignee: SHENZHEN IVPS TECHNOLOGY CO., LTD., Shenzhen (CN)

( * ) Notice: Subject to any disclaimer, the term of this patent is extended or adjusted under 35 U.S.C. 154(b) by 873 days.

(21) Appl. No.: 16/503,526

(22) Filed: Jul. 4, 2019

(65) Prior Publication Data

US 2020/0008477 A1 Jan. 9, 2020

(30) Foreign Application Priority Data

Jul. 5, 2018 (CN) ..... 201821063444.X

(51) Int. Cl.

| | |
|---|---|
| ***A24F 47/00*** | (2020.01) |
| ***A24F 40/46*** | (2020.01) |
| ***H05B 3/46*** | (2006.01) |
| *A24F 40/20* | (2020.01) |

(52) U.S. Cl.

CPC ..... *A24F 40/46* (2020.01); *H05B 3/46* (2013.01); *A24F 40/20* (2020.01)

(58) Field of Classification Search

CPC ..... A24F 40/46

See application file for complete search history.

(56) References Cited

FOREIGN PATENT DOCUMENTS

| | | | | |
|---|---|---|---|---|
| CN | 106617324 A | * | 5/2017 | ..... A24F 47/008 |
| CN | 106617324 A | | 5/2017 | |
| CN | 107373757 A | * | 11/2017 | ..... A24F 47/008 |
| CN | 107373757 A | | 11/2017 | |
| WO | 2013076098 A | | 5/2013 | |

* cited by examiner

*Primary Examiner* — Eric Yaary

(74) *Attorney, Agent, or Firm* — IP-PAL Patent US; Klaus Michael Schmid

(57) ABSTRACT

The present invention discloses an electronic cigarette, comprising a main body and a heating device, wherein the main body is provided with a first locking member and a mounting chamber with an opening, the heating device is provided with a second locking member, the heating device is mounted to the mounting chamber along the opening, the second locking member is engaged with the first locking member to lock the heating device to the main body to form a locked state; one of the main body and the heating device is further provided with a driving member, and the main body is further provided with an through hole through which the external detaching device is inserted to extrude the driving member, so that the driving member drives the second locking member to be separated from the first locking member.

19 Claims, 4 Drawing Sheets

ELECTRONIC CIGARETTE

TECHNICAL FIELD

The present invention relates to an electronic cigarette.

BACKGROUND

Studies have shown the use of "heating non-burning". Related studies have shown that nicotine and some tobacco flavor components can be transferred to smoke in a manner of only heating but not burning tobacco at a lower temperature below 500° C. Compared to traditional burning cigarettes, low temperature cigarettes can significantly reduce the release of tar and harmful components as a whole. At the same time, there is basically no sidestream smoke, which is of little harm to others and the environment.

The existing low-temperature flue-cured tobacco is usually provided with a heating chamber for the user to add tobacco products, and then the tobacco products in the heating chamber are heated by providing a heating device. However, the substance produced by the tobacco products during heating tends to adhere to the surface of the heating chamber and the heating device, and the heating chamber cannot be detached from the electronic cigarette. When cleaning, the cleaning device needs to extend into the heating chamber to clean the chamber wall of the heating chamber and the surface of the heating device, so that it is more difficult to clean and the degree of cleaning is lower.

However, the existing structure for detaching the heating device from the main body usually snap-fits the heating device with the main body, and then the heating device is controlled to be separated from the main body by an elastic lock button. There is also a deficiency that the elastic lock button is exposed to the outside of the main body and is easily extruded when being placed in a pocket to result in false triggering.

SUMMARY

The main object of the present invention is to provide an electronic cigarette, which is intended to facilitate the detachment of the heating device from the main body for cleaning, and to effectively prevent the phenomenon that the heating device is detached from the main body due to false triggering.

In order to achieve the above object, the present invention provides an electronic cigarette, comprising a main body and a heating device, wherein the main body is provided with a first locking member and a mounting chamber with an opening, the heating device is provided with a second locking member, the heating device is mounted to the mounting chamber along the opening, the second locking member is engaged with the first locking member to lock the heating device to the main body to form a locked state; one of the main body and the heating device is further provided with a driving member, and the main body is further provided with an through hole through which the external detaching device is inserted to extrude the driving member, so that the driving member drives the second locking member to be separated from the first locking member.

Preferably, the main body is provided with a retaining port communicated with the mounting chamber, the first locking member comprises an elastic locking arm and a locking head, one end of the locking head is received in the mounting chamber, and the other end is mounted to the elastic locking arm through the retaining port; the elastic locking arm is mounted in the main body and is elastically abutted against the main body to press the locking head into the mounting chamber, the elastic locking arm is partially corresponding to the through hole to form the driving member, the outer surface of the heating device is provided with a locking groove to form the second locking member; the heating device is mounted to the mounting chamber along the opening, the locking head is clamped in the locking groove to lock the heating device to the main body; the external detaching device passes through the through hole to press the driving member so that the locking head is separated from the locking groove.

Preferably, the elastic locking arm comprises a connecting arm, an elastic member and a rotating shaft, the connecting arm comprises a locking end in which the locking head is mounted and a driving end in which the driving member is mounted, the connecting arm is mounted in the main body through the rotating shaft, when the driving member is extruded by the external detaching device to rotate the driving end along the rotating shaft toward the mounting chamber, the locking end rotates along the rotating shaft away from the mounting chamber to disengage the locking head from the inner space of the mounting chamber; and the elastic member is elastically abutted against between the main body and the connecting arm to press the locking head into the mounting chamber.

Preferably, one end of the driving end away from the driving member is provided with a positioning portion, one end of the elastic member is mounted in the positioning portion, and the other end is elastically abutted against the outer chamber wall of the mounting chamber.

Preferably, one end of the locking head facing the opening is further provided with a guiding portion, when the heating device is mounted along the opening to be in contact with the guiding portion, the guiding portion is extruded to slide the locking head from the mounting chamber along the retaining port; and/or the locking groove extends in the circumferential direction of the heating device.

Preferably, the second locking member comprises a limiting head and an elastic body, the heating device is provided with an groove, the limiting head is slidably mounted in the groove, the elastic body is elastically abutted between the limiting head and the bottom groove wall of the groove, the mounting chamber is provided with a limiting notch facing the through hole to form the first locking member, the heating device is mounted to the mounting chamber along the opening, the limiting head is engaged in the limiting notch, the heating device is locked to the main body; and one end of the detaching device passes through the through hole to press the limit head such that the limit head moves along the sliding slot to be detached from the limiting notch.

Preferably, the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

Preferably, the ejecting mechanism comprises a supporting base and an elastic member, the supporting base is slidably mounted to the main body and is at least partially received in the mounting chamber, one end of the elastic member is abutted against the supporting base, and the other end is abutted against the main body; the heating device is abutted against the supporting base when being mounted in the mounting chamber along the opening, the heating device pushes the supporting base to extrude the elastic member moving from the disengaged state position to the locked state position; when the second locking member is separated from the first locking member, the elastic member pushes the supporting base to move so that the heating device moves from the locked state to the disengaged position.

Preferably, the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

Preferably, the heating base comprises a base body and a heat generating component, the base body is provided with an inner chamber, one end of the tobacco container is detachably mounted to the base body, and the heat generating component is received in the inner chamber and is partially received in the receiving space through the base body.

The electronic cigarette of the technical solution of the present invention is provided with a first connecting member and a second connecting member which are matched and connected and locked, so that when the heating device is mounted to the mounting chamber, the heating device is locked to the main body, and then an through hole is provided in the main body. When the user needs to clean the heating device, only the external detaching device needs to be inserted into the main body to extrude the driving member so that the driving member drives the second locking member to be separated from the first locking member, and then the heating device is pulled out from the mounting chamber to complete the detachment. Then the detached heating device is cleaned, effectively preventing water flow from immersing into the main body during cleaning to damage the electronic components in the main body. Compared with the conventional method in which a control button is provided on the outer surface of the main body to press and drive the second locking member and the first locking member, the technical solution is provided with an through hole, and the external detachment device is inserted into the main body along the through hole, effectively preventing the phenomenon that the second locking member is separated from the first locking member due to the erroneous operation.

BRIEF DESCRIPTION OF THE DRAWINGS

For a better illustration of the embodiments of the present invention or the technical solution in the prior art, accompanying drawings needed in the description of the embodiments or the prior art are simply illustrated below. Obviously, the accompanying drawings described below are some embodiments of the present invention. For those skilled in the art, other accompanying drawings may be obtained according to the structure shown in these accompanying drawings without creative work.

DESCRIPTION OF THE REFERENCE NUMBERS

Figure 1:
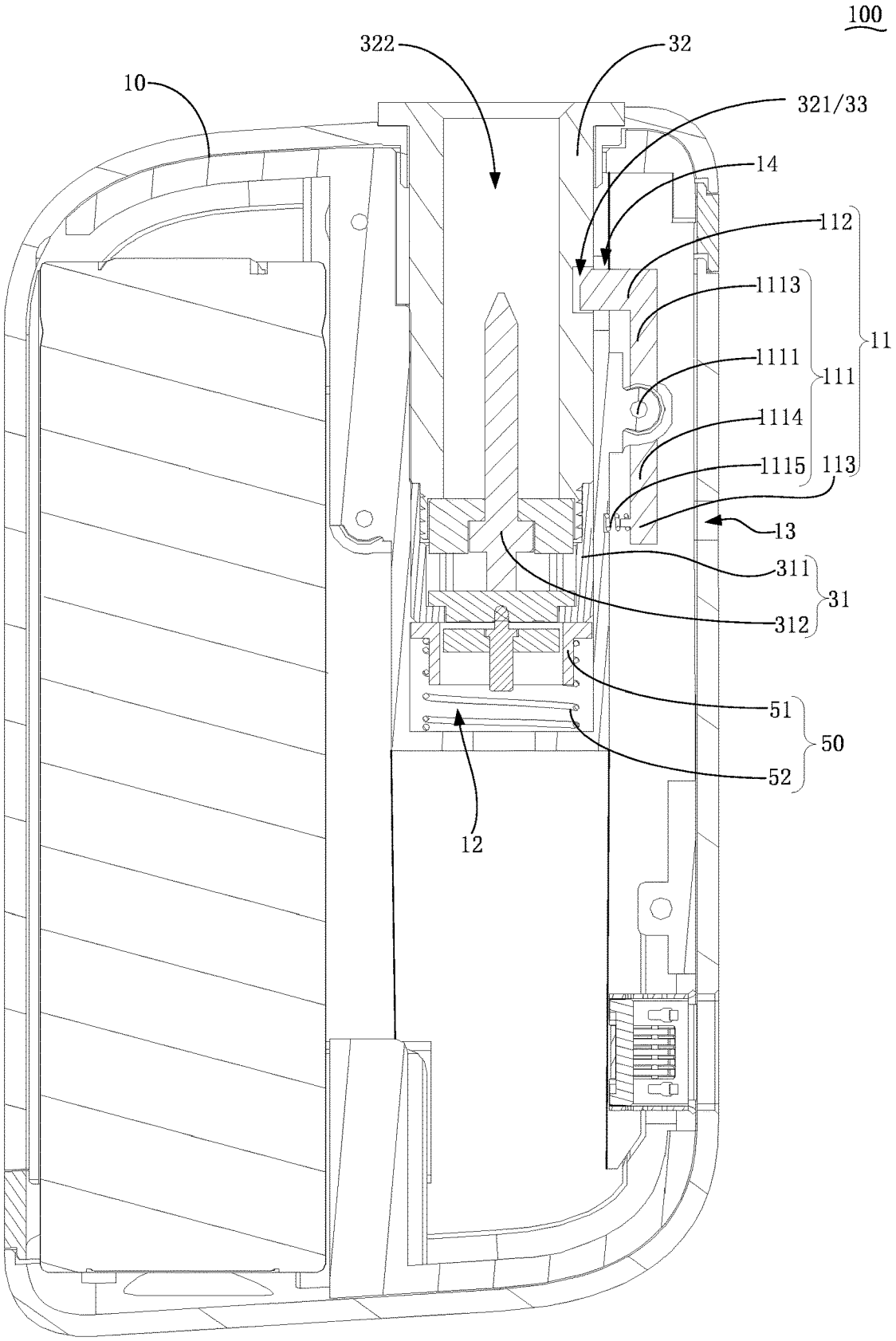
FIG. 1 is a cross-sectional schematic diagram illustrating a connecting structure of a heating device locked to a main body of an electronic cigarette according to the present invention.

| Reference number | Name of part |
|---|---|
| 100 | electronic cigarette |
| 10 | Main body |
| 11 | first locking member |
| 111 | elastic locking arm |
| 1111 | rotating shaft |
| 1112 | connecting arm |
| 1113 | locking end |
| 1114 | driving end |
| 1115 | elastic member |
| 1116 | positioning portion |
| 112 | locking head |
| 1121 | guiding portion |
| 113 | driving member |
| 12 | mounting chamber |
| 121 | limiting notch |
| 13 | Through hole |
| 14 | Retaining port |
| 30 | heating device |
| 31 | heating base |
| 311 | Base body |
| 3111 | Inner chamber |
| 3112 | Groove |
| 312 | heat generating component |
| 32 | heat generating component |
| 321 | locking groove |
| 322 | receiving space |
| 33 | second locking member |
| 331 | limiting head |
| 332 | elastic body |
| 50 | ejecting mechanism |
| 51 | supporting base |
| 52 | elastic element |
| 200 | detaching device |

The implementation of aims, the function features and the advantages of the present disclosure are described below in further detail in conjunction with embodiments with reference to the drawings.

DESCRIPTION OF THE EMBODIMENTS

A clear and complete description as below is provided for the technical solution in the embodiments of the present invention in conjunction with the drawings in the embodiments of the present invention. Obviously, the embodiments described hereafter are simply part embodiments of the present invention, rather than all the embodiments. All other embodiments obtained by those skilled in the art based on the embodiments in the present invention without creative work are intended to be included in the scope of protection of the present invention.

It should be noted that all directional indications (such as top, bottom, left, right, front, behind . . . ) in the embodiments of the present invention are merely to illustrate a relative position relation, a relative motion condition, etc. between each part in a certain state (for example, the state shown in the drawings). If the state changes, the directional indication changes accordingly.

In addition, if terms "first", "second", etc. appear in the present invention, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the present invention may be combined mutually; however, this must be carried out on the basis that those skilled in the art can implement the combination. When the combination of technical solutions has a conflict or cannot be implemented, it should considered that such combination of technical solutions does not exist and is not in the scope of protection claimed by the present invention.

In the present invention, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the present invention according to specific conditions.

The present invention provides a low temperature electronic cigarette 100 adopting "heating non-burning". Only heating but not burning tobacco at a lower temperature below 500° C. enables nicotine and some tobacco flavor components to be transferred to smoke, significantly reducing the release of tar and harmful components.

Referring to FIG. 1 to FIG. 4, in the embodiment of the present invention, the electronic cigarette 100 comprises a main body 10 and a heating device 30, wherein the main body 10 is provided with a first locking member 11 and a mounting chamber 12 with an opening, the heating device 30 is provided with a second locking member 33, the heating device 30 is mounted to the mounting chamber 12 along the opening, the second locking member 33 is engaged with the first locking member 11 to lock the heating device 30 to the main body 10 to form a locked state; one of the main body 10 and the heating device 30 is further provided with a driving member 113, and the main body 10 is further provided with an through hole 13 through which the external detaching device 200 is inserted to extrude the driving member 113, so that the driving member 113 drives the second locking member 33 to be separated from the first locking member 11. Here, in the present embodiment, the detaching device 200 is a ejector pin, and the ejector pin passes through the through hole to extrude the driving member 113 to drive the second locking member 33 to be separated from the first locking member 11.

The electronic cigarette 100 of the technical solution of the present invention is provided with a first connecting member and a second connecting member which are matched and connected and locked, so that when the heating device 30 is mounted to the mounting chamber 12, the heating device 30 is locked to the main body 10, and then an through hole is provided in the main body 10. When the user needs to clean the heating device 30, only the external detaching device 200 needs to be inserted into the main body 10 to extrude the driving member 113 so that the driving member 113 drives the second locking member 33 to be separated from the first locking member 11, and then the heating device 30 is pulled out from the mounting chamber 12 to complete the detachment. Then the detached heating device 30 is cleaned, effectively preventing water flow from immersing into the main body 10 during cleaning to damage the electronic components in the main body 10. Compared with the conventional method in which a control button is provided on the outer surface of the main body 10 to press and drive the second locking member 33 and the first locking member 11, the technical solution is provided with an through hole 13, and the external detachment device 200 is inserted into the main body 10 along the through hole 13, effectively preventing the phenomenon that the second locking member 33 is separated from the first locking member 11 due to the erroneous operation.

Figure 2:
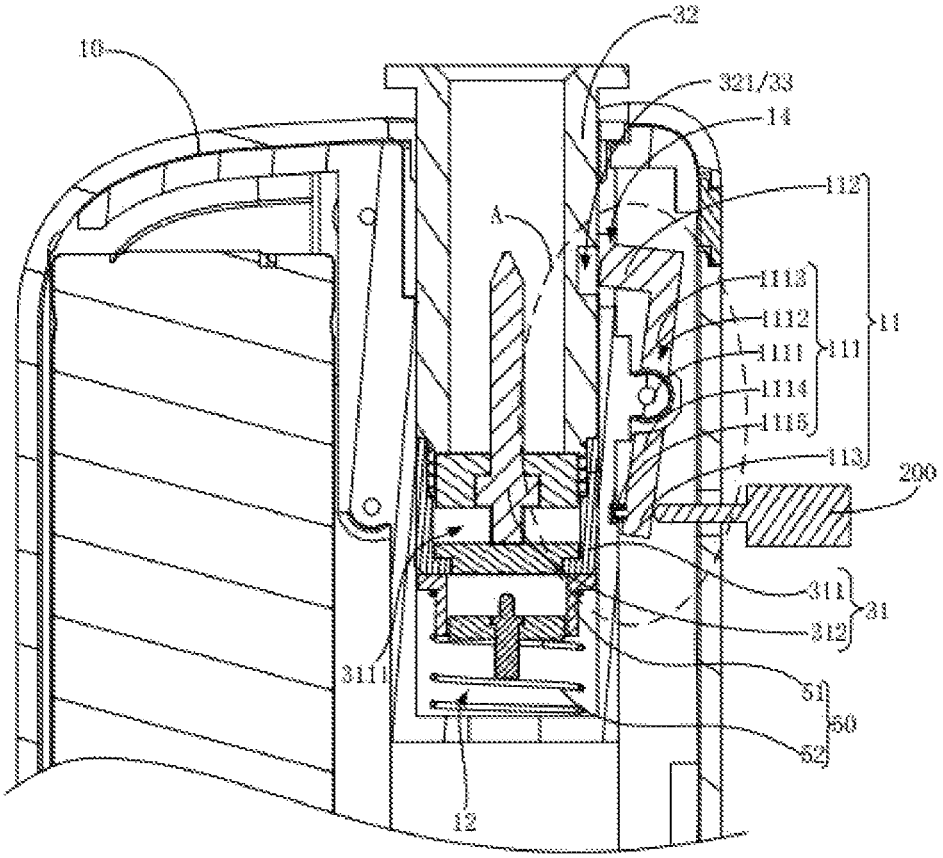
FIG. 2 is a cross-sectional schematic diagram illustrating a connecting structure of a heating device detached from a main body of an electronic cigarette according to the present invention.
Figure 3:
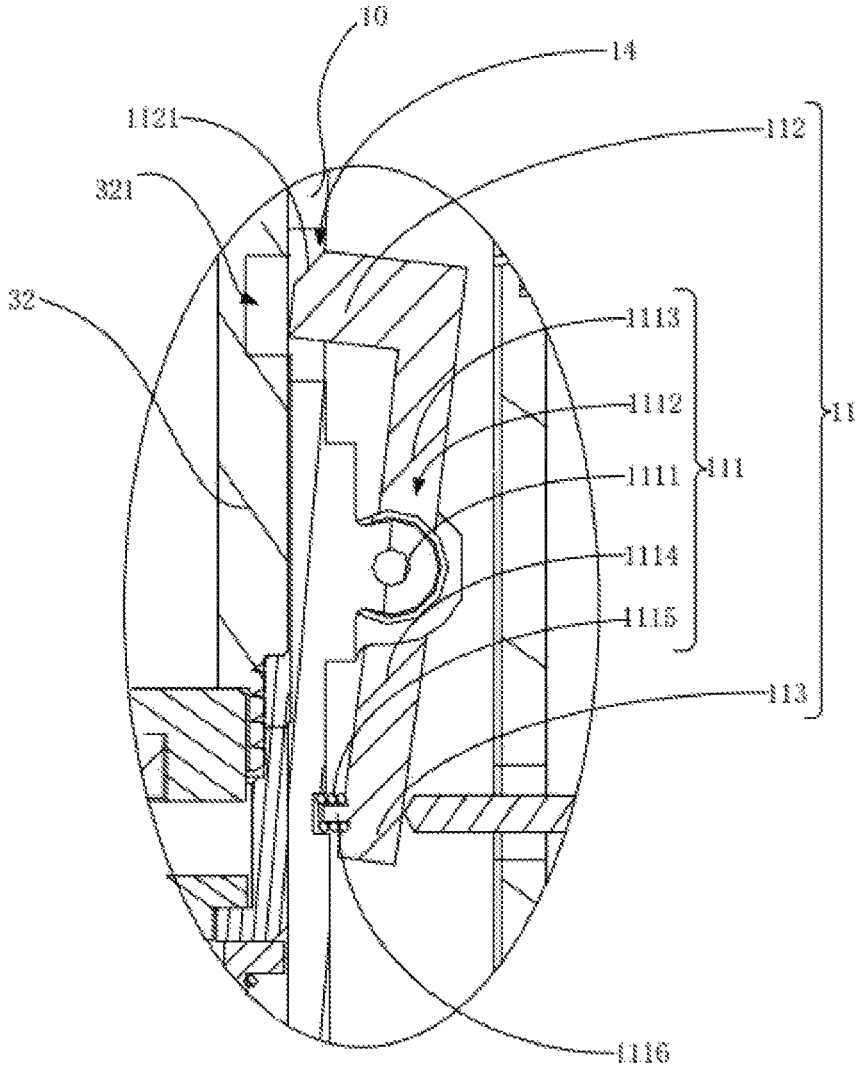
FIG. 3 is a partial enlarged diagram at A of FIG. 2 according to the present invention.

Specifically, as shown in FIG. 1 to FIG. 3, in the first embodiment of the present invention, the main body 10 is provided with a retaining port 14 communicated with the mounting chamber 12, the first locking member 11 comprises an elastic locking arm 111 and a locking head 112, one end of the locking head 112 is received in the mounting chamber 12, and the other end is mounted to the elastic locking arm 111 through the retaining port 14; the elastic locking arm 111 is mounted in the main body 10 and is elastically abutted against the main body 10 to press the locking head 112 into the mounting chamber 12, the elastic locking arm 111 is partially corresponding to the through hole 13 to form the driving member 113, the outer surface of the heating device 30 is provided with a locking groove 321 to form the second locking member 33; the heating device 30 is mounted to the mounting chamber 12 along the opening, the locking head 112 is clamped in the locking groove 321 to lock the heating device 30 to the main body 10; the external detaching device 200 passes through the through hole 13 to press the driving member 113 so that the locking head 112 is separated from the locking groove 321. Here, in the present embodiment, one end of the locking head 112 is received in the mounting chamber 12 by the elastic pressing force of the elastic locking arm 111, when the heating device 30 is mounted in the mounting chamber 12 along the opening, the locking head 112 is snap-fit in the locking groove 321 to lock the heating device 30 to the main body 10; during detachment, the user uses the external detaching tool to pass through the through hole 13 to be abutted against the driving member 113, so as to extrude the elastic locking arm 111, so that the locking head 112 slides out from the mounting chamber 12 to be separated from the locking groove 321, and then the heating device 30 is pulled out from the mounting chamber 12. It is convenient to detach, effectively preventing the phenomenon of erroneous operation. When the detachment is completed and the user pulls out the detaching tool, the locking head 112 is placed in the mounting chamber 12 under the elastic pressing force of the elastic locking arm 111 so that the user inserts the heating device 30 into the mounting chamber 12 for locking next time.

Specifically, as shown in FIG. 1 to FIG. 3, in the first embodiment of the present invention, the elastic locking arm 111 comprises a connecting arm 1112, an elastic member 1115 and a rotating shaft 1111, the connecting arm 1112 comprises a locking end 1113 in which the locking head 112 is mounted and a driving end 1114 in which the driving member 113 is mounted, the connecting arm 1112 is mounted in the main body 10 through the rotating shaft 1111, when the driving member 113 is extruded by the external detaching device 200 to rotate the driving end 1114 along the rotating shaft 1111 toward the mounting chamber 12, the locking end 1113 rotates along the rotating shaft 1111 away from the mounting chamber 12 to disengage the locking head 112 from the inner space of the mounting chamber 12; and the elastic member 1115 is elastically abutted against between the main body 10 and the connecting arm 1112 to press the locking head 112 into the mounting chamber 12. Here, the elastic member 1115 may be a spring, an elastic silicone, an elastic plastic or the like. In the present embodiment, the elastic member 1115 is a pressure spring, the connecting arm 1112 is mounted to the main body 10 through the rotating shaft 1111, and the rotating shaft 1111 is mounted in the middle of the connecting arm 1112. The connecting arm 1112 is divided into a locking end 1113 in which the locking head 112 is mounted and a driving end 1114 in which the driving member 113 is mounted, forming a lever principle; therefore, the driving end 1114 and the locking end 1113 rotate in opposite directions, and the elastic member 1115 is elastically abutted between the driving end 1114 and the outer surface of the mounting chamber 12. When the driving end 1114 moves in the direction away from the mounting chamber 12 under the elastic force of the elastic member 1115, the driving end 1114 rotates along the rotating shaft 1111 toward the mounting chamber 12 so that the locking head 112 is inserted into the mounting chamber 12 along the retaining port 14; when the user extrudes the driving member 113 through the through hole 13 using a detaching tool, the driving end 1114 is driven to move toward the mounting chamber 12 and extrude the elastic member 1115 so that the locking end 1113 moves away from the mounting chamber 12 to drive the locking head 112 to be disengaged from the locking groove 321. When the detaching tool is pulled out, the elastic member 1115 pushes the driving end 1114 to move away from the mounting chamber 12 under the elastic restoring force, thereby sliding the locking head 112 into the mounting chamber 12. When the user inserts the heating device 30 into the mounting chamber 12 next time, the heating device 30 is locked to the main body 10. In the manner of forming the lever by the rotating shaft 1111, the user extrudes the driving member 113 through the detaching device 200, which is labor-saving and convenient for the user to control. At the same time, the smaller deflection amount can drive the locking head 112 to slide along the retaining port 14 for a longer distance, thereby effectively reducing the occupied space and having higher stability.

It can be understood that the elastic member 1115 is not limited to being provided between the driving end 1114 and the outer surface of the mounting chamber 12 as described above. For example, The manner, in which the elastic member 1115 can also be elastically against between the surface of the locking end 1113 away from the locking head 112 and the main body 10, so that the locking head 112 is inserted into the mounting chamber 12 along the retaining port 14 under the pressing force of the elastic member 1115, is within the scope of protection of the present invention. Similarly, the elastic member 1115 is not limited to the above pressure spring. For example, a torsion spring may be selected. The manner, in which the torsion spring is sleeved on the rotating shaft 1111, so that the locking head 112 is inserted into the mounting chamber 12 along the retaining port 14 under the pressing force of the elastic member 1115, is within the scope of protection of the present invention.

Specifically, as shown in FIG. 3, in the first embodiment of the present invention, one end of the driving end 1114 away from the driving member 113 is provided with a positioning portion 1116, one end of the elastic member 1115 is mounted in the positioning portion 1116, and the other end is elastically abutted against the outer chamber wall of the mounting chamber 12. Here, the positioning portion 1116 may be formed by a positioning groove or a positioning post. In the embodiment of the present invention, one end of the driving end 1114 away from the driving member 113 is provided with a positioning post to form the positioning portion 1116, one end of the elastic member 1115 is sleeved on the positioning post and is elastically abutted against the driving end 1114, and the other end is elastically abutted against the outer surface of the mounting chamber 12, effectively preventing the phenomenon that the elastic member 1115 is detached during use.

Further, as shown in FIG. 3, in the first embodiment of the present invention, the main body 10 is further provided with a positioning groove (not labeled) corresponding to the elastic member 1115, one end of the elastic member 1115 is received in the positioning groove, and the other end is sleeved on the positioning post, further preventing the phenomenon that the elastic member 1115 is detached. At the same time, when the driving end 1114 rotates, the positioning post can be inserted into the positioning groove, effectively increasing the deflection amount of the driving end 1114, thereby saving mounting space.

Specifically, as shown in FIG. 3, in the first embodiment of the present invention, one end of the locking head 112 facing the opening is further provided with a guiding portion 1121, and when the heating device 30 is mounted along the opening to be in contact with the guiding portion 1121, the guiding portion 1121 is extruded to slide the locking head 112 from the mounting chamber 12 along the retaining port 14. Here, in the present embodiment, one end of the locking head 112 facing the opening is further provided with a wedge-shaped guiding portion 1121. The heating device 30 is in contact with the wedge-shaped surface when mounted, and the locking head 112 is extruded to slide from the mounting chamber 12. When the heating device 30 is mounted to the locking groove 321 to exactly face the retaining port 14, the pressing force applied by the heating device 30 to the locking head 112 disappears. The locking head 112 is inserted into the locking groove 321 under the force of the elastic member 1115. The heating device 30 is locked to the main body 10, effectively preventing the phenomenon that the heating device 30 is abutted against and jammed by the locking head 112 during mounting so that the heating device cannot be inserted into the mounting chamber 12.

Specifically, the locking groove 321 extends in the circumferential direction of the heating device 30. Here, in the present embodiment, the locking groove 321 extends in the circumferential direction of the heating device 30, so that the locking groove 321 is provided around the heating device 30 for a circle. When the heating device 30 is mounted to the mounting chamber 12 in any direction, the locking head 112 can be inserted into the locking groove 321 to lock the heating device 30. There is no need to additionally provide a positioning device to be mounted in the mounting chamber 12 in a fixed direction, which is convenient for the user to mount.

It can be understood that, in the actual application process, the second locking member 33 is formed not only in the manner of using the limiting groove around the heating device 30 for a circle. For example, a flange (not shown) may be provided on the outer peripheral surface of the heating device 30. The manner, in which when the heating device 30 is mounted to the mounting chamber 12, the flange extrudes the limiting head 331 to slide the limiting head 331 out of the mounting chamber 12, and when the flange is mounted to the lower end of the retaining port 14, the locking head 112 is inserted into the mounting chamber 12 under the force of the elastic member 1115 to lock the flange into the mounting chamber 12, thereby locking the heating device 30 to the main body 10, is also within the scope of protection of the present invention.

Figure 4:
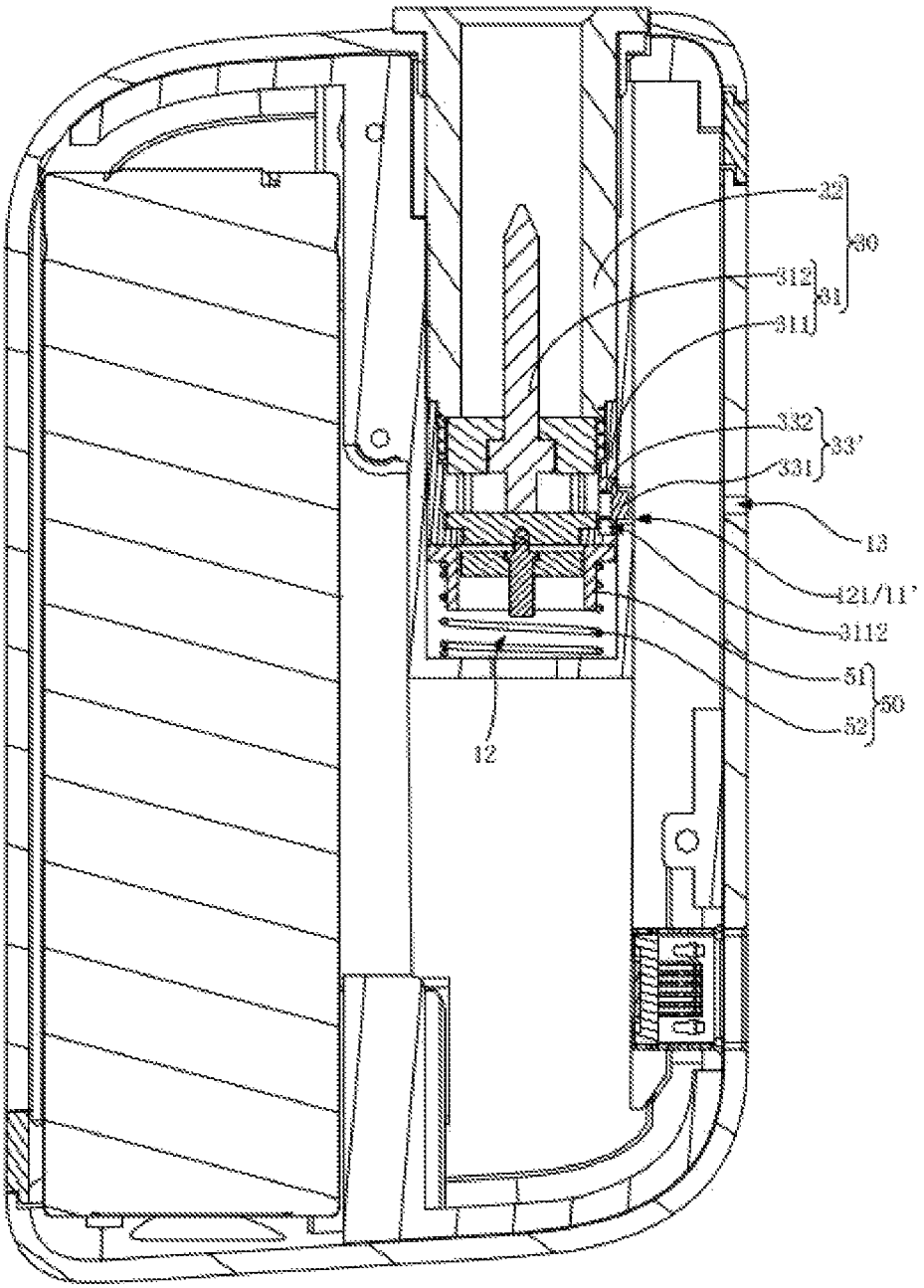
FIG. 4 is a cross-sectional schematic diagram illustrating a connecting structure of a heating device locked to a main body of an electronic cigarette according to a second embodiment of the present invention.

Specifically, as shown in FIG. 4, in the second embodiment of the present invention, the second locking member 33' comprises a limiting head 331 and an elastic body 332, the heating device 30 is provided with an groove 3112, the limiting head 331 is slidably mounted in the groove 3112, the elastic body 332 is elastically abutted between the limiting head 331 and the bottom groove wall of the groove 3112, the mounting chamber 12 is provided with a limiting notch 121 facing the through hole 13 to form the first locking member 11', the heating device 30 is mounted to the mounting chamber 12 along the opening, the limiting head 331 is engaged in the limiting notch 121, the heating device 30 is locked to the main body 10; and one end of the detaching device 200 passes through the through hole 13 to press the limit head 331 such that the limit head 331 moves along the sliding slot to be detached from the limiting notch 121. Here, the elastic body 332 may be a spring, an elastic silicone, an elastic plastic or the like. In another embodiment of the present invention, in the embodiment, the elastic body 332 is a spring, the limiting head 331 is slidably mounted to the groove 3112, and the elastic member 1115 is elastically abutted between the bottom groove wall of the groove 3112 and the limiting head 331, so that when the limiting head 331 is not subjected to external pressure, the elastic member 1115 presses the limiting head 331 to protrude from the groove 3112 outside the heating device 30. Then, the mounting chamber 12 is provided with a limiting notch 121 at the position facing the through hole 13 by the main body 10 to form the first locking member 11'. The end of the limiting head 331 facing the mounting chamber 12 is provided with a wedge-shaped surface, so that when the heating device 30 is mounted to the mounting chamber 12 along the opening, the wedge-shaped surface of the limiting head 331 is first in contact with the inner wall of the mounting chamber 12, thereby pushing the limiting head 331 to slide toward the groove 3112 to extrude the elastic body 332. When the heating device 30 is mounted to the groove 3112 to exactly face the limiting notch 121, the limiting head 331 is inserted into the limiting notch 121 under the force of the elastic body 332 to lock the heating device 30 to the main body 10. When the user needs to clean the heating device 30, the detached ejector pin is abutted against the limiting head 331 through opening of the through hole 13 and the groove 3112, and then the limiting head 331 is extruded to be separated from the opening of the groove 3112, so that the heating device 30 is pulled out. It is easy to operate, effectively preventing the phenomenon of erroneous operation at the same time.

Further, as shown in FIG. 1 or FIG. 2, in the embodiment of the present invention, the electronic cigarette 100 further comprises an ejecting mechanism 50, the ejecting mechanism 50 is mounted to the main body 10 and is at least partially received in the main body 10, the heating device 30 extrudes the ejecting mechanism 50 when being locked to the main body 10, when the second locking member 33 is separated from the first locking member 11, the ejecting mechanism 50 pushes the heating device 30 to move outwardly along the mounting chamber 12 so that the heating device 30 partially protrudes from the opening to form a disengaged state. Here, in the present embodiment, the ejecting mechanism 50 is provided so that the heating device 30 is elastically abutted against the elastic mechanism when locked to the main body 10. When the user separates the first locking member 11 from the second locking member 33 using the detaching tool, the ejecting mechanism 50 ejects the heating device 30 so that the heating device 30 partially protrudes from the opening to the outside. At the same time, the second locking member 33 provided by the ejected heating device 30 is separated from the first locking member 11. When the external force applied by the user to the driving member 113 disappears, the second locking member 33 and the first locking member 11 will not be re-snap-fit, further effectively facilitating the user to operate without applying a force by the user for a long time, resulting in the phenomenon that it is inconvenient to pull out the heating device 30 from the main body 10.

Specifically, as shown in FIG. 1 or FIG. 2, in the embodiment of the present invention, the ejecting mechanism 50 comprises a supporting base 51 and an elastic member 52, the supporting base 51 is slidably mounted to the main body 10 and is at least partially received in the mounting chamber 12, one end of the elastic element 52 is abutted against the supporting base 51, and the other end is abutted against the main body 10; the heating device 30 is abutted against the supporting base 51 when being mounted in the mounting chamber 12 along the opening, the heating device 30 pushes the supporting base 51 to extrude the elastic element 52 when moving from the disengaged state position to the locked state position; when the second locking member 33 is separated from the first locking member 11, the elastic member 52 pushes the supporting base 51 to move so that the heating device 30 moves from the locked state to the disengaged position. Here, the elastic member 52 may be a spring, an elastic silicone, an elastic plastic or the like. In the present embodiment, the elastic member 52 is a spring, the supporting base 51 is slidably mounted in the mounting chamber 12, and the outer peripheral surface of the supporting base 51 is fitted to the inner peripheral surface of the mounting chamber 12. One end of the elastic member 52 is elastically abutted against the chamber wall of the mounting chamber 12 away from the opening, and the other end is elastically abutted against the supporting base 51. The heating device 30 is elastically abutted against an end of the supporting base 51 away from the elastic member 52 when being mounted to the heating base 31 along the opening, so that the supporting base 51 can push the heating device 30 to move to the disengaged position along the mounting chamber 12 under the elastic restoring force of the elastic member 52. At the same time, a supporting base 51 is provided to cover the elastic member 52, so that the aesthetic appearance performance is high. In addition, the outer peripheral surface of the supporting base 51 is fitted to the inner peripheral surface of the mounting chamber 12, effectively preventing the phenomenon that the supporting base 51 waggles during the movement.

Specifically, as shown in FIG. 1 or FIG. 2, in the embodiment of the present invention, the heating device 30 comprises a heating base and a tobacco container 32 mounted to the heating base, the tobacco container 32 is provided with a receiving space 322 configured to receive the tobacco products, one of the heating base and the tobacco container 32 is provided with a second locking member 33, the heating base is electrically connected to the main body 10 when being locked to the main body 10, and the main body 10 drives the heating device 30 to heat the tobacco products in the receiving space 322. Here, in the present embodiment, the tobacco container 32 is a hollow sleeve. One end of the sleeve is provided with a connecting thread. The heating base 31 is provided with an internal thread, and the heating base and the internal thread are detachably connected by thread engagement. When cleaning, the sleeve can be detached from the heating base 31, and then immersed and cleaned by clear water or cleaning liquid. The outer surface of the heating base 31 is also cleaned by wiping, thereby effectively preventing the phenomenon that the heating base 31 and the sleeve cannot be detached and it is easy for water to enter the heating base 31 to cause a short circuit when being cleaned.

It can be understood that, in the actual application process, the sleeve and the heating base 31 are not limited to the above detachable manner using a threaded connection. For example, the detachable connection manners such as snaps or latches are also within the scope of protection of the present invention.

Specifically, as shown in FIG. 1 or FIG. 2, in the embodiment of the present invention, the heating base comprises a base body 311 and a heat generating component 312, the base body 311 is provided with an inner chamber 3111, one end of the tobacco container 32 is detachably mounted to the base body 311, and the heat generating component 312 is received in the inner chamber 3111 and is partially received in the receiving space 322 through the base body 311. Here, in the present embodiment, the heat generating component 312 is partially received in the receiving space 322 through the base body 311, and the tobacco products received in the receiving space 322 can be directly heated, effectively improving the heating efficiency and reducing energy consumption.

It can be understood that, in the actual application process, the heat generating component 312 is not limited to the above manner of directly heating the tobacco products received inside the receiving space 322 through the base body 311. For example, the manner, in which the heat generating component 312 can also heat the tobacco container 32 by winding the heating wire around the outer wall of the tobacco container 32, thereby heating the inner receiving space 322 of the tobacco container 32, is also within the scope of protection of the present invention.

The above are preferred embodiments of the present invention merely and are not intended to limit the patent scope of the present invention. Any equivalent structures made according to the description and the accompanying drawings of the present invention without departing from the idea of the present invention, or any equivalent structures applied in other relevant technical fields directly or indirectly are intended to be included in the patent scope of protection of the present invention.

What is claimed is:

1. An electronic cigarette, comprising a main body and a heating device, wherein the main body is provided with a first locking member and a mounting chamber with an opening, the heating device is provided with a second locking member, the heating device is mounted to the mounting chamber along the opening, the second locking member is engaged with the first locking member to lock the heating device to the main body to form a locked state; one of the main body and the heating device is further provided with a driving member, and the main body is further provided with a through hole through which an external detaching device is inserted to extrude the driving member, so that the driving member drives the second locking member to be separated from the first locking member; wherein the main body is provided with a retaining port communicated with the mounting chamber, the first locking member comprises an elastic locking arm and a locking head, one end of the locking head is received in the mounting chamber, and the other end is mounted to the elastic locking arm through the retaining port; the elastic locking arm is mounted in the main body and is elastically abutted against the main body to press the locking head into the mounting chamber, the elastic locking arm is partially corresponding to the through hole to form the driving member, the outer surface of the heating device is provided with a locking groove to form the second locking member; the heating device is mounted to the mounting chamber along the opening, the locking head is clamped in the locking groove to lock the heating device to the main body; the external detaching device passes through the through hole to press the driving member so that the locking head is separated from the locking groove.

2. The electronic cigarette according to claim 1, wherein the elastic locking arm comprises a connecting arm, an elastic member and a rotating shaft, the connecting arm comprises a locking end in which the locking head is mounted and a driving end in which the driving member is mounted, the connecting arm is mounted in the main body through the rotating shaft, when the driving member is extruded by the external detaching device to rotate the driving end along the rotating shaft toward the mounting chamber, the locking end rotates along the rotating shaft away from the mounting chamber to disengage the locking head from the inner space of the mounting chamber; and the elastic member is elastically abutted against between the main body and the connecting arm to press the locking head into the mounting chamber.

3. The electronic cigarette according to claim 2, wherein one end of the driving end away from the driving member is provided with a positioning portion, one end of the elastic member is mounted in the positioning portion, and the other end is elastically abutted against the outer chamber wall of the mounting chamber.

4. The electronic cigarette according to claim 1, wherein one end of the locking head facing the opening is further provided with a guiding portion, when the heating device is mounted along the opening to be in contact with the guiding portion, the guiding portion is extruded to slide the locking head from the mounting chamber along the retaining port; and/or the locking groove extends in the circumferential direction of the heating device.

5. The electronic cigarette according to claim 1, wherein the second locking member comprises a limiting head and an elastic body, the heating device is provided with a groove, the limiting head is slidably mounted in the groove, the elastic body is elastically abutted between the limiting head and the bottom groove wall of the groove, the mounting chamber is provided with a limiting notch facing the through hole to form the first locking member, the heating device is mounted to the mounting chamber along the opening, the limiting head is engaged in the limiting notch, the heating device is locked to the main body; and one end of the detaching device passes through the through hole to press the limit head such that the limit head moves along the sliding slot to be detached from the limiting notch.

6. The electronic cigarette according to claim 1, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

7. The electronic cigarette according to claim 6, wherein the ejecting mechanism comprises a supporting base and an elastic member, the supporting base is slidably mounted to the main body and is at least partially received in the mounting chamber, one end of the elastic member is abutted against the supporting base, and the other end is abutted against the main body; the heating device is abutted against the supporting base when being mounted in the mounting chamber along the opening, the heating device pushes the supporting base to extrude the elastic member when moving from the disengaged state position to the locked state position; when the second locking member is separated from the first locking member, the elastic member pushes the supporting base to move so that the heating device moves from the locked state to the disengaged position.

8. The electronic cigarette according to claim 1, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

9. The electronic cigarette according to claim 8, wherein the heating base comprises a base body and a heat generating component, the base body is provided with an inner chamber, one end of the tobacco container is detachably mounted to the base body, and the heat generating component is received in the inner chamber and is partially received in the receiving space through the base body.

10. The electronic cigarette according to claim 1, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

11. The electronic cigarette according to claim 2, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

12. The electronic cigarette according to claim 3, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

13. The electronic cigarette according to claim 4, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

14. The electronic cigarette according to claim 5, wherein the electronic cigarette further comprises an ejecting mechanism, the ejecting mechanism is mounted to the main body and is at least partially received in the main body, the heating device extrudes the ejecting mechanism when being locked to the main body, when the second locking member is separated from the first locking member, the ejecting mechanism pushes the heating device to move outwardly along the mounting chamber so that the heating device partially protrudes from the opening to form a disengaged state.

15. The electronic cigarette according to claim 1, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

16. The electronic cigarette according to claim 2, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

17. The electronic cigarette according to claim 3, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

18. The electronic cigarette according to claim 4, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

19. The electronic cigarette according to claim 5, wherein the heating device comprises a heating base and a tobacco container mounted to the heating base, the tobacco container is provided with a receiving space configured to receive the tobacco products, one of the heating base and the tobacco container is provided with a second locking member, the heating base is electrically connected to the main body when being locked to the main body, and the main body drives the heating device to heat the tobacco products in the receiving space.

* * * * *